US005271319A

United States Patent [19]

Plagemann

[11] Patent Number: 5,271,319

[45] Date of Patent: Dec. 21, 1993

[54] ROLL PRESS WITH DEAERATION APPARATUS

[75] Inventor: Werner A. Plagemann, Bochum, Fed. Rep. of Germany

[73] Assignee: Maschinenfabrik Köppern GmbH & Co. KG, Hattingen, Fed. Rep. of Germany

[21] Appl. No.: 916,008

[22] PCT Filed: Feb. 1, 1991

[86] PCT No.: PCT/EP91/00189

§ 371 Date: Aug. 4, 1992

§ 102(e) Date: Aug. 4, 1992

[87] PCT Pub. No.: WO91/11320

PCT Pub. Date: Aug. 8, 1991

[30] Foreign Application Priority Data

Feb. 5, 1990 [DE] Fed. Rep. of Germany ..... 4003342

[51] Int. Cl.[5] ..... B30B 9/00; B30B 3/04

[52] U.S. Cl. ..... 100/90; 100/139; 100/155 R; 100/173; 100/907; 241/52; 241/57; 241/227; 425/237

[58] Field of Search ..... 100/90, 138, 139, 140, 100/155 R, 168, 173, 907; 222/152; 241/52, 53, 57, 58, 224, 225, 227; 425/237

[56] References Cited

U.S. PATENT DOCUMENTS

| | | | |
|---|---|---|---|
| 1,188,323 | 6/1916 | Richardson | 241/57 |
| 1,822,999 | 9/1931 | Peters | 241/53 X |
| 2,675,304 | 4/1954 | Komarek | 100/907 X |
| 3,029,723 | 4/1962 | Schweer . | |
| 3,114,930 | 12/1963 | Oldham et al. . | |
| 3,196,044 | 7/1965 | Kott et al. | 100/90 X |
| 3,269,611 | 8/1966 | Komarek . | |
| 3,282,199 | 11/1966 | Mason et al. | 100/90 |
| 3,620,157 | 11/1971 | Rieschel | 100/155 R X |
| 3,781,151 | 12/1973 | Harris | 435/237 X |
| 4,125,208 | 11/1978 | Bettermann | 222/152 |
| 4,601,728 | 7/1986 | Dungs et al. | 425/237 X |
| 4,661,364 | 4/1987 | Campbell | 222/152 X |

FOREIGN PATENT DOCUMENTS

| | | | |
|---|---|---|---|
| 1141162 | 12/1962 | Fed. Rep. of Germany . | |
| 1757093 | 3/1971 | Fed. Rep. of Germany . | |
| 2605099 | 9/1976 | Fed. Rep. of Germany . | |
| 2615585 | 10/1977 | Fed. Rep. of Germany . | |
| 3220916 | 12/1983 | Fed. Rep. of Germany . | |
| 3733500 | 4/1989 | Fed. Rep. of Germany . | |
| 3806398 | 9/1989 | Fed. Rep. of Germany . | |
| 288810 | 4/1991 | Fed. Rep. of Germany | 100/173 |

*Primary Examiner*—Stephen F. Gerrity
*Attorney, Agent, or Firm*—Ralph H. Dougherty

[57] ABSTRACT

Roll press or mill with two adjacent rolls (2, 4) with cooperating compression surfaces, mounted in bearing housings located between an upper and lower box girder, one roll being adjustable, with a material feed system with at least one fill chamber (6) with walls (22, 24) parallel to the roll axes and extending into the roll gap (8) and with apparatus to eliminate the air entering the roll gap with the material, provided with air admission holes in the region of the roll gap leading into an air collection chamber connected with air outlets. On each side of the fill chamber walls, parallel to the axes, chambers (16, 18) extend essentially over the breadth of the compression surfaces of the rolls and are closed at their ends. The chambers are each connected to the roll gap by a passage (28, 30) formed between the compression surfaces at the perimeter of the rolls and the lower end of the walls adjacent to the walls of the filling chamber. The chambers (16, 18) are provided with air outlets (34, 36).

9 Claims, 1 Drawing Sheet

ROLL PRESS WITH DEAERATION APPARATUS

BACKGROUND OF THE INVENTION

The present invention relates to a roll press or roll pressing mill with two opposed pressing rolls having a roll gap between them, a material charging device projecting into the roll gap, and means for removing gases from the roll gap.

In the case both of materials for pressing which have a high air content, for example fine-grained materials which have fluid like properties due to the natural inclusion of air, and also of materials which are crushed in the material bed of a roll press and thereby converted into solid agglomerates, difficulties frequently arise with regard to the deaeration of the material. Air which is enclosed by the material and enters the roll gap is highly compressed together with the material to be pressed. This can result in the removal of stress after the exit from the roll gap in the agglomerates produced by the roll press in the form of scabs or briquets being destroyed. Enclosed amounts of air can also result in scab or flake formation, or can make it impossible to form satisfactory briquets, or to achieve the necessary pressures for burden comminution.

Adequate deaeration of the material to be pressed represents a solution to these problems. Proposals are known for this.

In the case of a roll press of the kind having two opposed pressing rolls having a roll gap between them, a material charging device projecting into the roll gap, and means for removing gases from the roll gap (as in U.S. Pat. No. 3,029,723), there is arranged in the charging hopper vertically above the roll gap a compartment which projects with its lower end, which is constructed permeable to air, into the roll gap and which is connected through the front-side walls of the feed hopper to air outlet lines. Such deaeration devices arranged inside the charging hopper have the disadvantage that they impede the flow of material. The very small air inlet openings required in this case at the lower end of the compartment, of the order of magnitude of 1/10 mm and smaller, moreover easily lead to blockages of the openings, which make the device ineffective.

There is also known in the case of roll presses with screw conveyors to provide on the charging hoppers in which the screws rotate of openings or spaces which are covered with filter media and to which a suction fan is connected. In the case of a roll press according to U.S. Pat. No. 3,114,930, a space, to which the suction fan is connected, is to be separated off above the screw by a permeable wall extending obliquely to the axis of the charging screw. In a further known arrangement according to U.S. Pat. No. 3,269,611, suction openings covered with filter media are provided in the conical charging hopper wall above the screw. In this case the surfaces of the filter media are to be kept open by skimmers connected to the screw shaft.

It is further known in German OLS 37 33 500 to provide venting (deaerating) outlets in the wall elements surrounding the roll gap, which outlets are covered with filters to prevent the escape of fine-grained material to be compressed.

Also known from German ALS 17 57 093 is a roll mill in which the material to be comminuted is fed in a continuous stream which is accelerated in a gravity drop shaft which ends at a distance from the roll gap, up to about the peripheral speed of the rolls. Entrained air in this case escapes above the rolls and is returned through a duct provided with louvers into the gravity shaft in order to prevent the material in the gravity shaft from being decelerated by air resistance. Air introduced with the material flow through openings above the roll gap is drawn off to prevent extraction of dust.

All these known devices have the common disadvantage that, together with the air to be carried away, particularly the fine fractions of the material for pressing are necessarily entrained by the escaping or exhausted air. These fine fractions of the materials lead however to blockages on both sides of the filter medium which are particularly difficult to remove.

OBJECT OF THE INVENTION

The object of the invention is to provide a roll press having means for achieving reliable deaeration without problems occurring due to blockage of the paths by which the air is able to escape.

This object is achieved by providing for a roll press a material feed system with at least one fill chamber (6) with walls (22, 24) parallel to the roll axes and extending into the roll gap (8) and with means to eliminate the air entering the roll gap with the material, provided with air admission holes in the region of the roll gap leading into an air collection chamber connected with air outlets. On each side of the fill chamber walls, parallel to the axes, chambers (16, 18) extend essentially over the breadth of the compression surfaces of the rolls and are closed at their ends. The chambers are each connected to the roll gap by means of a passage (28, 30) formed between the compression surfaces at the perimeter of the rolls and the lower end of the walls adjacent to the walls of the filling chamber. The chambers (16, 18) are provided with air outlets (34, 36).

SUMMARY OF THE INVENTION

Unlike the roll presses or mills of the generic type in which, among other things, the air and/or the inclusions in the roll gap are removed from the material to be compressed through the wells of a feed hopper, and in which the escape of materials to be compressed is prevented by filters; air escaping through the open ports into the chambers may entrain material to be compressed in the solution according to the invention. This material to be compressed can settle in the chambers, only the residual dust needs to be separated from the air to be drawn out of the chambers.

BRIEF DESCRIPTION OF THE DRAWINGS

The invention is illustrated by way of example in the drawings and described in detail below with reference to the drawings.

DETAILED DESCRIPTION

Figure 1:
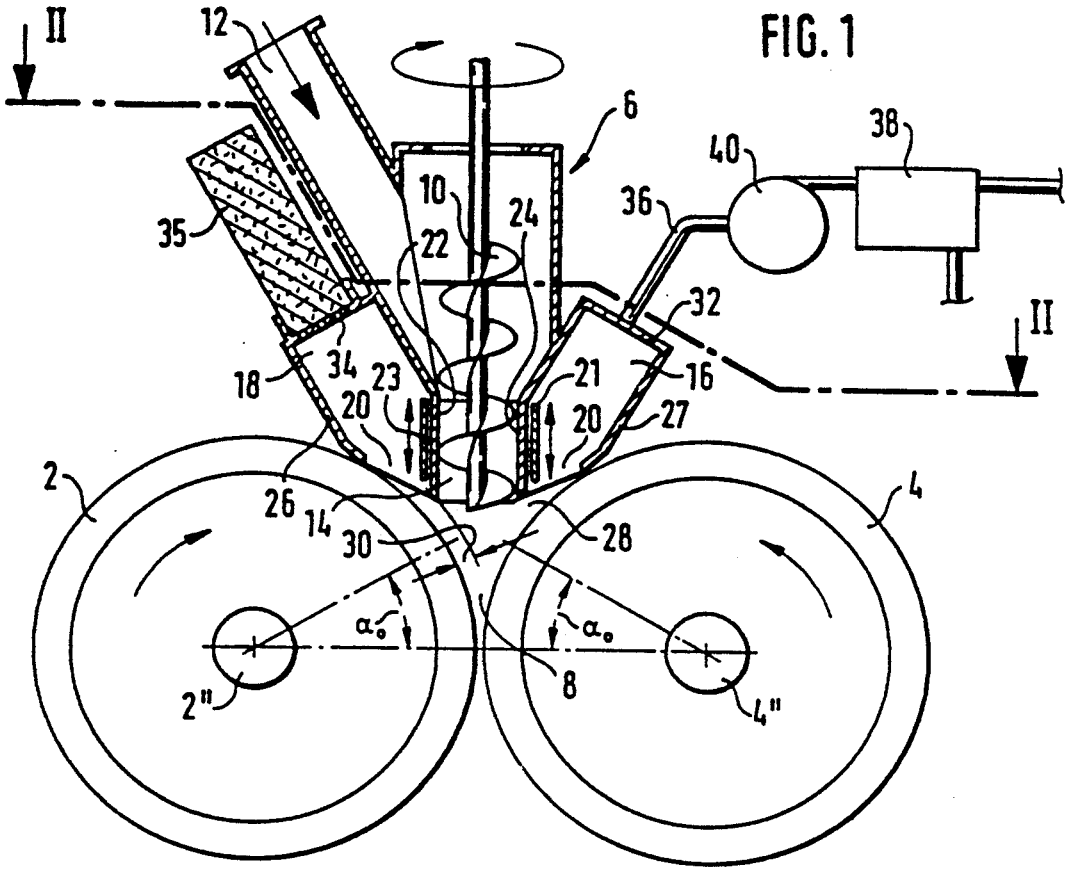
FIG. 1 shows schematically a roll press according to the invention in cross-section through the roll axis.

There are shown of the roll press in the drawing only the two rolls 2, 4 lying horizontally next to one another. These rolls are provided with their roll pins 2', 2'' and 4', 4'' with bearings by means of which they are supported in bearing housings which are arranged in the press frame (not shown) between an upper and a lower frame part. One of the rolls is moreover conventionally displaceable with its bearing housings against a flexible support.

The roll gap 8 is, in the case of such roll presses, which are also used as pressing mills, adjustable in known manner. The angle of nip $a_0$ is dependent on the roll diameter.

Figure 2:
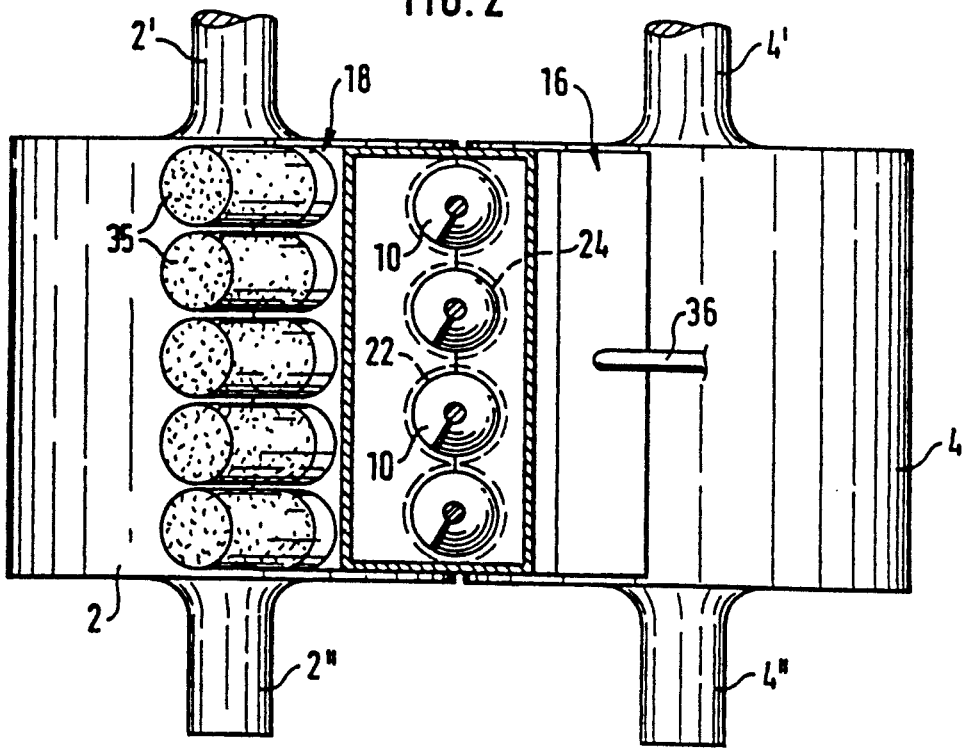
FIG. 2 shows the roll press arrangement according to FIG. 1 in an overhead view.

The roll press is provided with a charging hopper 6 which extends with its lower end into the roll gap 8. The charging hopper 6 is here represented with a forced feeding conveyance of the material by means of a charging or feed screw 10. The material for pressing is introduced into the charging hopper 6 via a lateral feed 12. As shown in FIG. 2, there are arranged next to one another in axial direction of the rolls 2,4 a plurality of charging screws 10, the screws 10 rotating in respectively associated casing or housing sections 14 which form respectively the lower end of the charging hopper 6. The upper part of the charging hopper 6 may be common to all the charging hoppers lying next to one another, it being possible for one or more feed hoppers 12 to be provided.

The charging hopper 6 may also be constructed in known manner as the charging hopper of a gravity distribution system, the material then being fed vertically from above into the charging hopper.

Details of such charging hoppers both for gravity conveyance and also for forced conveyance by means of charging screws are generally known. The lower end of the charging hopper is normally provided with a cover plate which rests against the periphery of the rolls 2, 4 and seals the roll gap across the periphery of the rolls 2, 4 to a large extent.

According to the invention compartments 16, 18 are provided on both sides of the charging hopper 6. These compartments extend substantially axially parallel across the width of the pressing surfaces of the rolls 2, 4. The lower region 20, 22 of the compartments 16, 18 is defined by the walls extending substantially axially parallel of the lower region of the charging hopper 6. This wall 22 or 24 may be a straight wall, but it may also be constructed corrugated in keeping with the outer contour of the lower region of the screw casings forming the lower end of the charging hopper 6. The walls 20, 22 delimit at their lower end, between themselves and the outer periphery of the rolls 2, 4, passages 28, 30 extending substantially across the width of the pressing surfaces of the rolls. The height of the passages may be adjustable by means of vertically adjustable slide members 21, 23, which are represented schematically in the drawing and are here arranged vertically adjustable on the outside of the charging hopper wall 22 and/or 24.

The facing longitudinal walls 26, 27 extend at their lower end against the periphery of the rolls 2, 4, and may be bent as shown, so that a substantial seal exists. In certain cases separate seal means may also be provided here.

The compartments 16, 18 are closed at their axial ends. Such closure may, at least in the lower region, also be sealed for example by the usual end wall sealing plates for the roll gap.

The compartments, which are closed by roof walls 32, 34, have air outlets to which dust separators 35, 36 are preferably connected. These dust separators may be mechanical dust separators 38, for example those with which the dust is separated by centrifugal force, for example cyclone filters or vortex filters, as shown on the right in the drawing. In this case there are connected to the compartments 16, 18 in each case air lines 36, by means of which the connection is made to centrifugal filters 38 or similar, to which blowers 40 may be connected upstream or downstream.

Filters 35 incorporating a filter medium, for example straining cloths or similar, may however also be provided, as shown on the left in the drawing. There are connected here to openings in the covers 34 respectively filters 35 incorporating a filter medium. A plurality of the latter may be provided, distributed over the length of the compartments, as shown in FIG. 2.

The compartments 16, 18 described above work as follows. Air which is conveyed by the material for pressing into the roll gap 8, i.e., for example is contained in the material which passes at the lower end of the charging screw 10 out of the charging hopper 6 into the roll gap 8, is expelled as far as possible out of the material while the material is being compressed by the rolls after the attainment by the roll press of the angle of nip $a_0$ dependent substantially on the roll diameter. It is able, moreover, to escape laterally over a short distance and passes through the passages 28, 30 into the compartments 16 and 18. At the same time material for pressing entrained by the air may and usually will enter into the compartments with the air.

Material which has entered the compartments 16, 18 may be transported again by the rolls 2,4 into the roll gap 8, where it is then compressed in the roll gap 8 with the rest of the material to be compressed. It should be noted here that the passage of material into the compartments 16, 18 is countered in each case by the roll surfaces rotating in the opposite direction to the openings 28, 30 into the compartments 16, 18, so that escape of excessive material into the compartments 16, 18 may be prevented.

Since the air is expelled by compression out of the material for pressing, there will build up in the compartments 16, 18 an air overpressure, by means of which the air collected in the compartments is expelled out of the compartments. The air is thus forced under overpressure through the filters 35 shown on the left in the drawing and in so doing is freed of the entrained dust. Such removal of dust by filter elements 35 incorporating a filter medium therefore requires no additional means for air conveyance. On the other hand such filter cartridges have to be serviced, i.e. replaced at regular intervals according to their degree of fouling. In cases where a considerable amount of dust is expected it may therefore be advisable to use mechanical filters 38 with centrifugal separation, for example the above-mentioned cyclone or vortex filters, it then being necessary to provide air exhaustion out of the compartments during the operation of such mechanical filters 38.

In order to prevent overcharging or overfilling of the compartments 16, 18 with material for pressing, the compartments may be provided with level sensors (not shown in the drawing). There may then be carried out by means of the level sensors a control of the material feed into the charging hopper 6, the feed being reduced for a short time by such control so that the material for pressing contained in the compartments 16, 18 is extracted from the latter by the rolls 2,4. The conveyance of the material for pressing out of compartments 16, 18 moreover takes place, as also during normal operation, by means of gravity and by means of the normally profiled surfaces of the rolls.

What is claimed is:

1. Roll press and deaeration apparatus, comprising:

two rolls arranged next to one another having interacting pressing surfaces and a roll gap therebetween, the rolls having parallel axes;

a material loading device including at least one charging hopper having walls extending parallel to the roll axes and projecting into said roll gap;

means for carrying away air which has entered said roll gap with said material, comprising an air collection compartment on each side of said charging hopper provided with air inlet openings in the region of said roll gap, and air outlet openings remote from said air inlets;

said air collection compartments (16, 18) being provided along the axially parallel charging hopper walls (22, 24) on both sides of said roll gap (8), said compartments extending substantially over the width of said pressing surfaces of said rolls (2, 4), and being closed at their ends;

each of said compartments (16, 18) communicating with said roll gap (8) via a passage (28, 30) defined by a pressing surface of said rolls and a lower end of said walls (22, 24) adjoining said charging hopper walls.

2. Roll press according to claim 1, wherein one compartment wall is formed in the region adjoining the passage (28, 30) by the adjoining charging hopper wall (22, 24) and that a wall (26, 27) being substantially parallel with the compartment (16, 18) cooperates at its lower end with the periphery of said rolls (2, 4) forming a seal therewith.

3. Roll press according to claim 1 further comprising dust separators (35, 38) connected to air outlets of compartments (16, 18).

4. Roll press according to claim 3, wherein said dust separators are centrifugal dust separators.

5. Roll press according to claim 3, wherein said dust separators comprise filters (35) which incorporate a filter medium therein.

6. Roll press according to claim 1, wherein said material loading device is a gravity feed charging hopper.

7. Roll press according to claim 1, wherein said material loading device is provided with, at least one charging screw (10).

8. Roll press according to claim 7, wherein a plurality of charging screws (10) are arranged adjacent one another in a row oriented in the axial direction of said rolls (2, 4).

9. Roll press according to claim 1, further comprising adjustable slide members (21, 23) in said air collection compartment, adapted to vary the height of said passages (28, 30).

* * * * *